US006942038B2

(12) United States Patent
Fonseca

(10) Patent No.: US 6,942,038 B2
(45) Date of Patent: Sep. 13, 2005

(54) MUD DIVERTER AND METHOD FOR HORIZONTAL DRILLING

(76) Inventor: David Fonseca, 3211 White Blossom, Humble, TX (US) 77338

( * ) Notice: Subject to any disclaimer, the term of this patent is extended or adjusted under 35 U.S.C. 154(b) by 83 days.

(21) Appl. No.: 10/602,398

(22) Filed: Jun. 23, 2003

(65) Prior Publication Data

US 2004/0256160 A1 Dec. 23, 2004

(51) Int. Cl.[7] ..... E21B 34/10
(52) U.S. Cl. ..... 166/316; 175/209
(58) Field of Search ..... 166/316, 332.5, 166/69, 90.1; 175/62, 78, 82, 209, 214, 230, 257

(56) References Cited

U.S. PATENT DOCUMENTS 4,441,556 A * 4/1984 Powers et al. ..... 166/290
5,101,913 A * 4/1992 Stockley et al. ..... 175/65
5,348,107 A * 9/1994 Bailey et al. ..... 175/162
6,578,638 B2 * 6/2003 Guillory et al. ..... 166/387

* cited by examiner

*Primary Examiner*—Frank S. Tsay
(74) *Attorney, Agent, or Firm*—Richard Esty Peterson

(57) ABSTRACT

A drilling mud diverter and method of use for horizontal drilling operations wherein drilling muds are diverted to a single portal of the bore where the drilling muds are recovered for removal or reprocessing, the mud diverter having a diverter unit with a central cylindrical core with enlarged end caps and an inflatable bladder mounted on the core, the diverter unit having a bypass passage through the unit blocked by a pressure relief valve that allows drilling muds blocked by the diverter unit to pass through the unit only when a preset pressure is reached; the method of use including the procedure for installing the mud diverter into an enlarged bore using the drilling pipe and removing the mud diverter using the drilling pipe, cables or other alternative equipment.

20 Claims, 3 Drawing Sheets

MUD DIVERTER AND METHOD FOR HORIZONTAL DRILLING

This invention relates to a mud diverter and a method of using a mud diverter in horizontal drilling. Horizontal drilling is primarily used as a means for installing a conduit for utility wires or pipeline for fluid transport where it is impossible or impractical to utilize simple trenching.

Horizontal drilling is initiated by anchoring a drilling rig at one end of a proposed bore. A small open pit adjacent the drilling rig is excavated at the proposed entry point. Drilling pipe carrying a drill bit at the lead end is set in a drill at an entry angle which is usually between eight and sixteen degrees. The drill is mounted on the angled bed of the drilling rig and provides both thrust and rotation to the drilling pipe and drill head with the drill bit. By the use of an appropriate drill bit, a pilot bore follows a predetermined path and is tracked using appropriate electronic tracking equipment. The drilling pipe is first directed downward at the entry angle with section of pipe added to the pipe string until a desired dept is achieved. Then, the drill head is steered in an upward sweeping curve to transition into a horizontal segment. The horizontal segment continues until the drill head is guided to an upward sweeping curve to the exit point. At the exit point the drilling pipe is inclined at an angle of five to ten degrees with the ground surface. During the drilling process the progress of the drill head is tracked and adjustments to the direction of travel are made to keep the drill head on course.

Guiding the drill head is aided by specialty drill bits, but depends greatly on the skill of the drilling rig operator. During the drilling process, specialty drilling mud is pumped through the drilling head and flows with the bore cuttings back through the drilled bore. The pit at the bore entry is used to contain the returning drilling fluids which are usually pumped to a reprocessor, particularly in large bore objects. In the reprocessor the mud is screened to remove the cuttings and reconditioned to allow the drilling muds to be reused.

When the pilot bore has been completed, the drill head is replaced with a reamer to enlarge the box. The reamer is generally rotated and pulled back through the pilot bore by the pipe string to enlarge the bore. One or more reaming passes are generally necessary, depending on the size of the finished bore required. In general, the final bore diameter must be fractionally larger than the diameter of the pipe or conduit that is to be installed in the bore. The pipe, conduit, electrical cable or bundle cable is called product or product line. The product line is attached to an end swivel that is attached to the drill pipe or to final oversized reamer at the end of the drilling pipe. To prevent the product line from becoming stuck in the bore and reamed hole, the product line is continuously pulled through the oversized hole.

Where larger holes are drilled, the quantity of drilling mud generally requires that the mud be reprocessed on site. Once the pilot bore has opened the bore hole at both ends, it is either necessary to employ two mud reprocessing plants or to transport the spent drilling mud from one bore portal to the other by truck, pipeline or other means of conveyance. It is a primary object of this invention to divert the drilling mud and cuttings to one portal by utilizing a pneumatic diverter to block the mud flow to the opposite portal.

SUMMARY OF THE INVENTION

This invention relates to mud diverter and method of operation for diverting drilling muds to a single portal in larger bore horizontal drilling operations. As the diameter of a horizontal bore is increased, the quantities of drilling mud required for the project become significant. The drilling mud diverter of this invention is positioned at an appropriate location in the bore and expanded to block the bore while allowing the pipe string to rotate and displace along its axis relative to the fixed position mud diverter. In the process of utilizing the mud diverter, drilling muds injected in the bore at the reamer are forced back around the pipe string through the enlarged bore to one of the two portals for recovery and reprocessing.

In the preferred embodiment and method, the expandable mud diverter is designed for a range of bore sizes, 24 inches to 60 inches. The mud diverter includes a cylindrical core having enlarged diameter end caps. The cylindrical core forms a sleeve on which an expandable bladder in the form of an annulus in secured. The enlarged end caps protect the bladder during installation and removal. An air supply is connected to the bladder enabling compressed air to be supplied to the interior of the bladder, which expands the bladder against the wall of the bore, fractionally locking the bladder in place. The mud diverter is designed with a central passage through the diverter that is sized to enable a pipe tail attached to the reamer to be drawn through the diverter. To accommodate the rotating pipe tail the end caps include fittings to support the rotating and displacing pipe tail On the side of the diverter where the drilling mud is deposited the diverter includes a swivel with flexible pipe seals for blocking passage of the drilling mud through the mud diverter.

In addition to the central passage, the pipe diverter includes a pressure relief conduit with a pressure relief valve allowing passage of mud through the diverter when the mud pressure rises to an unacceptable level.

In a typical operation, after the pilot hole has been completed and the reamer is attached, the bore is enlarged by a selected reamer which is pulled back through the bore hole. A pipe tail is attached to the reamer which follows the reamer back through the enlarged bore. The mud diverter is drawn into the enlarged bore by connecting to a tail pipe with a resalable connector that can position the diverter in the enlarged bore a sufficient distance from the portal to ensure that a firm seal is generated when the bladder is expanded. Typically, this distance is about one hundred feet. The mud diverter includes fastener anchors that connect the diverter to be withdrawn from the enlarged bore when the bladder is deflated and the drilling mud has been recovered.

These and other features of the preferred methods and embodiments of this invention are described in greater detail in the detailed description of the preferred embodiments that follows.

DETAILED DESCRIPTION OF THE PREFERRED EMBODIMENTS

Figure 1:
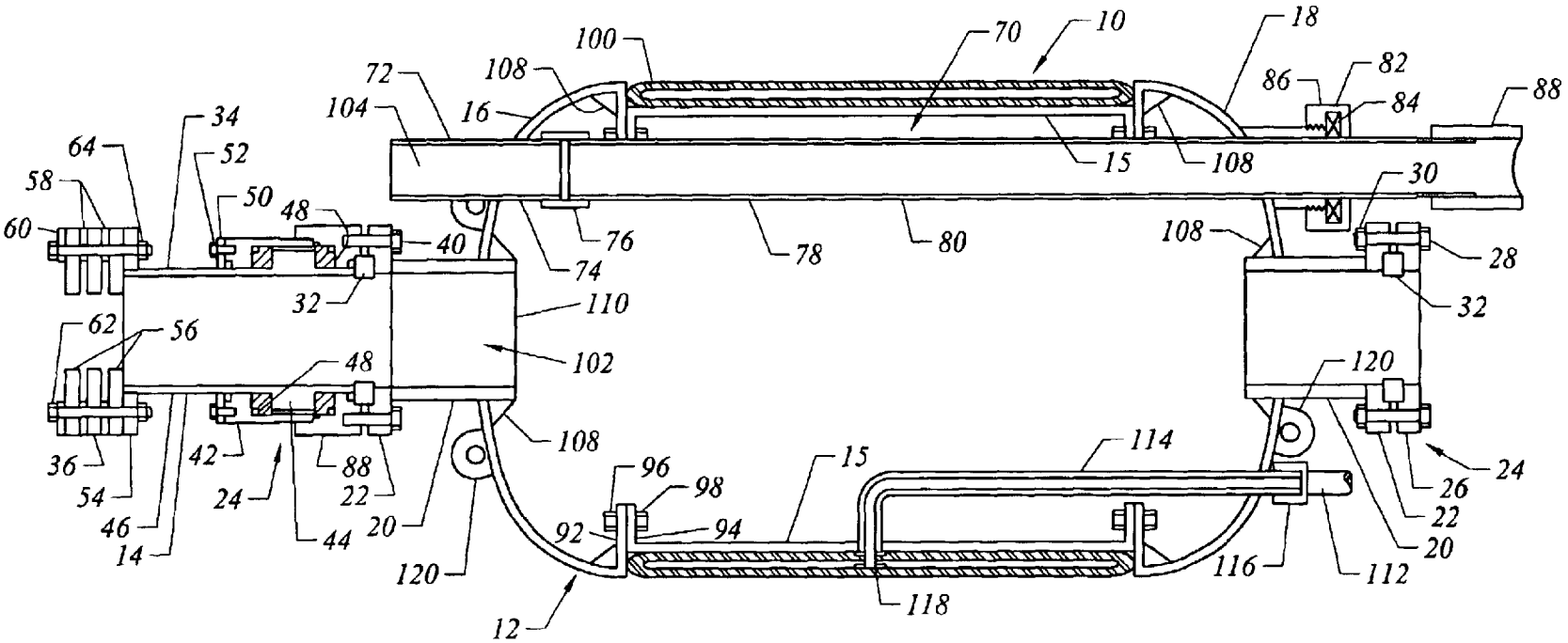
FIG. 1 is a cross-sectional view of the diverter of this invention with the diverter unit deflated.

In FIG. 1, the mud diverter, designated generally by the reference numeral 10, is shown in a horizontal cross-sectional view. The mud diverter 10 of FIG. 1 includes a mud diverter unit 12 in combination with a swivel unit 14. The swivel unit 14 is utilized when the diverter unit 12 is drawn into an enlarged bore by a tail pipe attached to the drill pipe string as described in greater detail with reference to FIG. 4.

The diverter unit 12 has a rigid cylindrical core 15 and two enlarged-diameter end caps 16 and 18 that are bell-shaped. The end caps 16 and 18 each have a projecting neck section 20 and end flanges 22. The end flanges 22 couple to end elements 24.

In the cross sectional view of FIG. 1, the end elements 24 comprise guide elements that assist in guiding a trailing pipe tail or leading pipe string through the diverter unit 12 as described with reference to FIG. 4. In the diverter 10 of FIG. 1 equipped with the swivel unit 14, the diverter 10 is installed in a drilled bore with the swivel unit 14 located on the side of the diverter unit 12 that the drilling mud is supplied. The flange 22 on the end cap 18 opposite the mud supply is coupled to a ring flange 26 by a series of spaced bolts 28 with nuts 30 to secure a wear ring 32 that is preferably constructed of a wear resistant material such as brass or Delrin®.

In the configuration of FIG. 1, which includes the swivel unit 14, the diverter 10 is configured for passage of interconnected drill pipe through the diverter unit 14. The segments of the drill pipe are connected as the drilling process progresses. Each length of pipe typically has an end with an enlarged tool joint. The diameter of the tool joint is slightly greater than the diameter of the remaining pipe. The wear ring, therefore, is sized to accommodate the pipe diameter and the slightly enlarged tool joint. Sealing of the diverter unit 12 is provided by the swivel unit 14, which includes a swivel assembly 34 and a sealing assembly 36. The swivel assembly 34 has a collet flange 38 connected to the end flange 22 of the diverter unit 12 by a series of spaced bolts 40. The collet flange 38 functions in part to trap the wear ring 32 and to connect the threaded collet flange 38 to a threaded ferrule 42, which in combination with the flange 38 trap an enlarged portion 44 of a rotatable guide sleeve 46. To facilitate rotation, a pair of low-friction bushing rings 48 are positioned on each side of the enlarged segment 44 of the guide sleeve 46. A wiper ring 50 is secured to the end of the ferrule 42 by a series of small bolts 52 to prevent contamination of the rotatable swivel connection. The end of the guide sleeve 46 is threaded to interconnect with a threaded end flange 54 on the seal assembly 36. The seal assembly includes a series of spaced, flexible pipe seals 56 with rigid spacer rings 58 interposed between adjacent seals. The spacer rings 58 and an outer clamping ring 60 have an inside diameter substantially greater than the inside opening diameter of the seals 56, allowing the seals to flex over the slightly enlarged hub of displacing drill pipe. The seals 56, spacer rings 58 and end ring 60 are secured to the flange 54 by bolts 62 and nuts 64. The seals 56, as noted, are sized to slide over the drill pipe and tool joint at the end of each pipe segment and prevent pressurized drilling mud from passing into the sleeve 46 and diverter unit 12 during rotation and displacement of the pipe string.

Figure 3B:
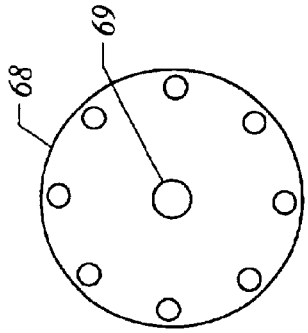
FIG. 3B is an end view of an alternate end element for the diverter unit of FIG. 1 in the form of a reduction flange.
Figure 3A:
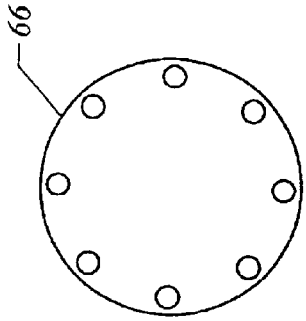
FIG. 3A is an end view of an alternate end element for the diverter unit of FIG. 1 in the form of a plug flange.

It is to understood that modifications to the structure described may be made. For example, the swivel assembly 34 can be omitted and the seal assembly 36 can be directly connected to the end flange 22. For certain uses each end elements 24 may comprise blind flange 66 as shown in FIG. 3A, where the drill pipe does not pass through the diverter unit 12. Alternately, a reduction flange 68 with a small center hole 69, as shown in FIG. 3B, can be utilized when a pull cable is threaded through the diverter unit 12 instead of a pipe tail. Other modifications will be apparent as operating experience is gained during use of the diverter system of this invention.

To prevent the pressurized drilling mud from rupturing or damaging the reamed bore as reaming progresses with the diverter 10 in place, a pressure relief bypass assembly 70 is included in the diverter unit 12. The pressure relief bypass assembly 70 includes a projecting pipe stub 72 welded to one of the end caps here the end cap 16. Internally, the pipe stub 72 has a projecting threaded end 74 that connects by a threaded coupler 76 to the threaded end 78 of a bypass pipe 80 which passes through the diverter unit 12 and the opposite end cap 18.

Mounted on the other end cap 18 is a slip coupler 82 with a compressible seal 84 and compression nut 86. This arrangement allows the diverter unit 12 to be disassembled for repair or inspection. Alternately, a continuous pipe segment can be welded to the end caps 16 and 18, requiring removal of the weld if disassembly is required. The bypass pipe 80 connects to a bypass and blocking conduit 88 leading to the exit portal where a pressure relief valve 90 blocks passage of drilling mud unless a specified pressure is reached. This pressure may vary according to the size of the bore, the depth, the geology of the formation, the potential for rupture or bulging of the surface and other factors that are taken into account when mud flow to the entry port is blocked. As shown in the cross sectional view of FIG. 2, the end caps 16 and 18 each have an integral inwardly directed flange 92 which couples to a complementary inwardly directed flange 94 on each end of the rigid core 15. The flanges 92 and 94 are interconnected by bolts 96 and nuts 98. An annular expandable bladder 100 is seated on the core 15. The smaller diameter of the core 15 allows the collapsed bladder 100 to have an outer diameter equal to or slightly less than the diameter of the end caps 16 and 18. This prevents scuffing or damage to the bladder when the diverter is installed into or removed from the bore. The bladder 100 is fabricated from rubber, neoprene or other expandable material commonly used in pipe plugs.

A single diverter unit can be used in a range of bore sizes. In the unit shown, the diverter 10 is designed for bore sizes from 24 inches to 60 inches. To accommodate the through passage 102 for the drill pipe and the bypass passage 104 for the mud diversion in the smaller bore size, an arcuate cut-out 106 in the flanges 92 and 94 is necessary for situating the bypass pipe 80. For strength, a series of gussets 108 are added to the bell flanges 92 and to an internal extension 110 of the neck portions 20 of the end caps 16 and 18.

For purposes of illustration in FIG. 1, an air pressure supply line 112 connects to an internal air supply pipe 114 by a projecting end cap connector 116 on the end cap 18 opposite bypass pipe 80. However, as shown in the cross sectional view of FIG. 2, it is preferred that the internal air supply pipe 114, the end cap connector 116 and supply line 112 be located adjacent the bypass pipe 80 allowing the supply line 112 to be strapped to the bypass and blocking conduit 88 to prevent entanglement with a pipe string during operation.

The projecting end caps connector 116 is an extension of the internal air pressure supply pipe 116 which connects to a bladder fitting 118 allowing the bladder 100 to be expanded by pressurized air from a remote compressor, typically located at the exit portal.

To install and retrieve the mud diverter 10, each end cap 16 and 18 have spaced eye brackets 120, preferably four eye brackets, welded to each of the end caps 16 and 18 for attachment of cable lines or chains. When the bore reaming is complete and the expanded bladder is deflated, the diverter 10 can be withdrawn by the cables attached to the eye brackets 120. Alternately, the mud diverter 10 can be withdrawn by pulling on the bypass and blocking conduit 88.

Figure 4:
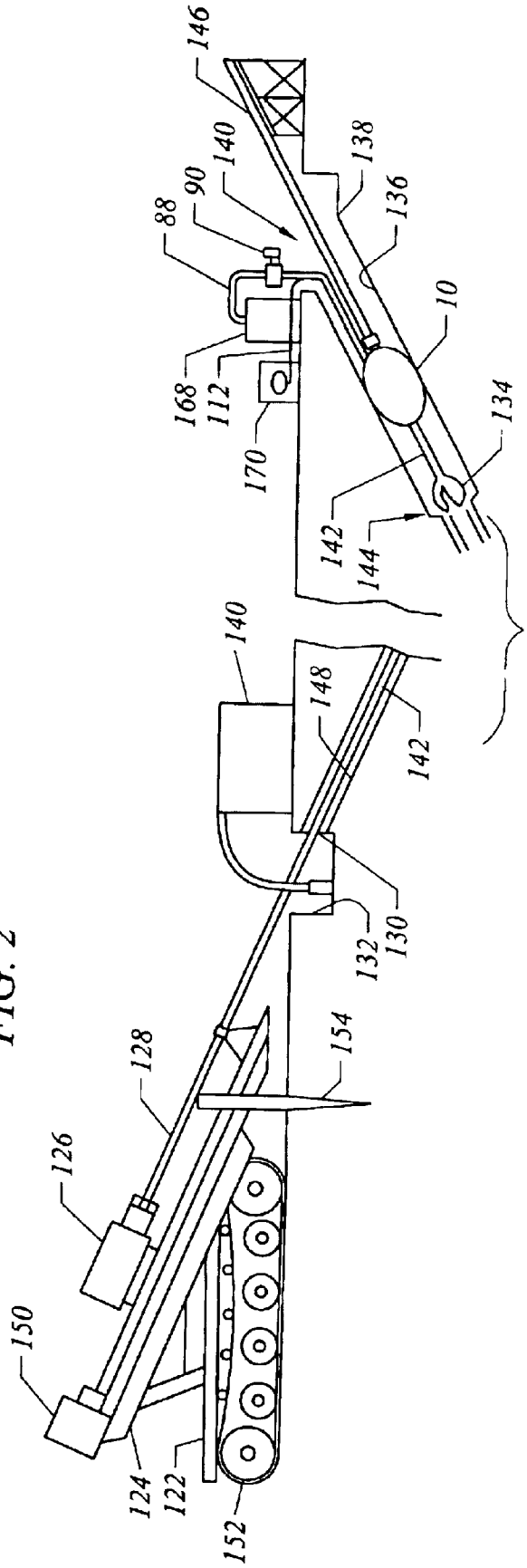
FIG. 4 is a schematic view illustrating a typical method of using the diverter of this invention in a horizontal drilling operation.
Figure 5:
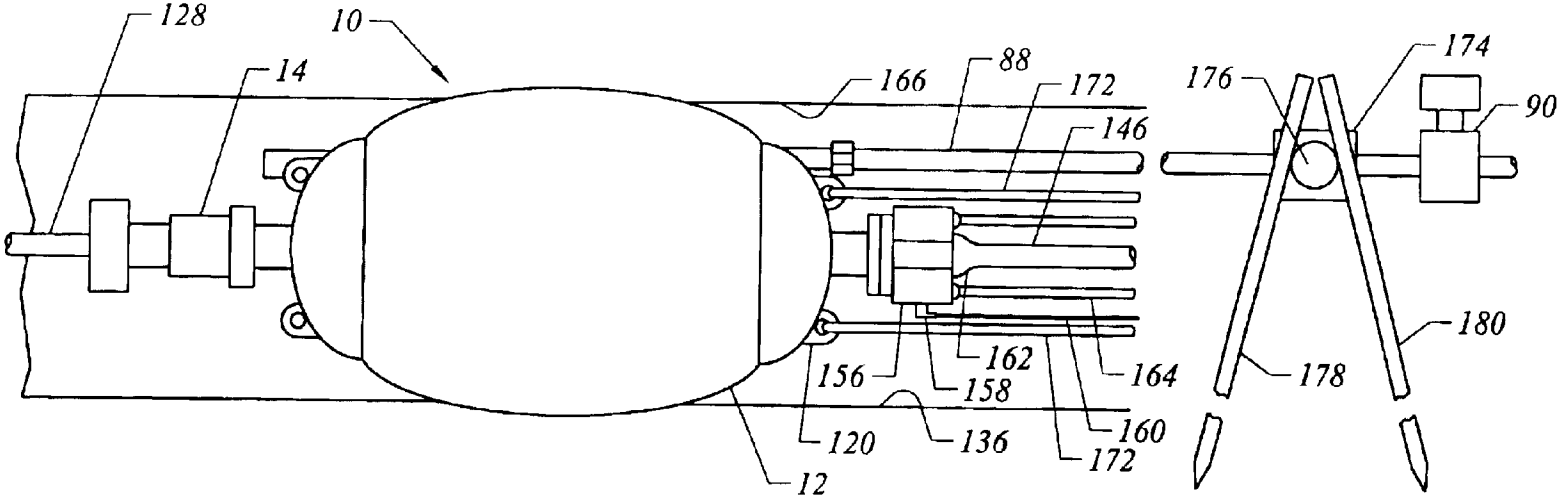
FIG. 5 is an enlarged view of the diverter in a bore with the diverter unit inflated.

Referring now to the schematic illustrations of FIGS. 4 and 5, the method of using the diverter 10 in a horizontal boring operation is shown. A drilling rig 122 has an angled bed 124 raised to an appropriate angle for a drill 126 to direct drill pipe 128 at an entry portal 130 in an entry pit 132.

The entry pit 132 collects the return of drilling mud that is piped through the drill pipe 128 under pressure to a drill bit or the reamer 134, as shown in the schematic of FIG. 4. With the diverter 10 installed and inflated in the enlarged bore 136 through the exit portal 138, drilling mud is blocked from flowing to an exit pit 140 and is forced to return with the cuttings to the entry pit 132. At the entry pit 132, the fluid drilling mud and cuttings are pumped to a reprocessing plant 140, shown schematically in FIG. 4. The connected drill pipe 128 forms a pipe string 142 to the drill head 144 having the mounted reamer 134. Connected drill pipe 128 from the reamer 134 through the diverter 10 to the exit portal 138 forms a pipe tail 146.

In the schematic illustration shown, the diverter 10 is being drawn into the enlarged bore 136 by retracting the pipe string 142. The pipe string 142 is drawn back through a smaller pilot bore 148 by the drill 126, which is displaced on the angled bed 124 by a drive engine 150. The drill rig 122 is prevented from moving by tracks 152 on the rig and stakes 154 attached to the angled bed 124 which are inserted into the ground. It is to be understood that the drill rig 122 may differ in construction and the rig shown is an example of the type of rig used for the diverter system described.

The diverter 10 is drawn into the enlarged bore 136 by being connected to the pipe tail 146. In the system shown, a conventional elevator 156 is coupled to the pipe tail 146 and blocks the diverter 10 from slipping on the pipe tail. An elevator 156 is a releasable pipe clamp or shackle typically used in vertical drilling operations to suspend drill pipe or a pipe string during the procedure of connecting or disconnecting a length of drill pipe from a pipe string. As schematically shown in FIG. 5 the elevator 156 has a latch 158 attached to a small release cable 160. The latch 158 holds the clamshell-like, elevator together around a drill pipe 128 at an enlarged tool joint 162.

When the diverter 10 is located at a desired distance from the exit portal 138, usually a safe distance to prevent damage to the bore or surface when expanded, the bladder 100 of the diverter unit 12 is expanded as shown in FIG. 5. Using the release cable 160, the latch 158 is released, opening the elevator 156, which frees the elevator 156 allowing the elevator 156 to be withdrawn from the enlarged bore 136 by two cables 164 connected on each side of the elevator 156. The inflated diverter 10 is maintained in position by force of the inflated bladder 100 against the wall 166 of the enlarged bore 136.

Drilling mud supplied through the pipe string 142 discharged from the drill head 144 at the reamer 134 is blocked from passage around or through the diverter unit 12 and is forced to flow back around the pipe string 142 through the pilot bore 148 to the entry pit 132 where it is recovered, and, in larger operations, reprocessed on site.

In the event pressure of the drilling mud on the entry side of the diverter exceeds a predetermined pressure, usually because of blockage in the pilot bore 148, a pressure relief valve 90, set to a selected pressure, opens allowing the excessively pressurized drilling mud to pass through the diverter unit 12 via the bypass pipe 80 and through the bypass and blocking conduit 88. This conduit, usually a four inch steel pipe can lead to the exit pit or preferably to a standby collection vessel 168 schematically shown in FIG. 5.

In the usual situation with the diverter 10 installed and inflated, pressure in the bladder is maintained by a compressor 170 connected to the air pressure supply line 112 until the reaming operation is completed. The air pressure is then relieved, collapsing the bladder 100 allowing the diverter unit 12 to be extracted. The diverter unit 12 is installed with cables 172 attached to the eyelets 120 on the end cap 18. The cables 172 can be attached to a vehicle (not shown) for withdrawing the diverter 10. Alternately, the cables 172 can be attached to the pipe tail 146 by connecting the elevator 156 to a segment of pipe 128 at the exit portal 138 and pushing out the pipe tail 146 which in turn pulls out the deflated diverter 10. The elevator is removed and reattached as each segment pipe 128 is disconnected from the pipe tail 140 until the diverter 10 is retrieved at the exit pit 140.

Because the weight of the drill pipe 128 exerts substantial forces on the diverter 10 as the pipe tail 146 is displaced through the diverter 10, the diverter is fixed in position not only by the friction of the expanded bladder against the bore wall, but by anchoring the diverter 10.

This is accomplished by an anchor block 174 having a tee 176 for spanning the pipe tail 146 and cables 164 and 172 and mounting of inner stakes 178 and outer stakes 180 at the exit pit 140 preventing movement of the diverter 10 in either direction by advanced retracted drill pipe 128.

Figure 6:
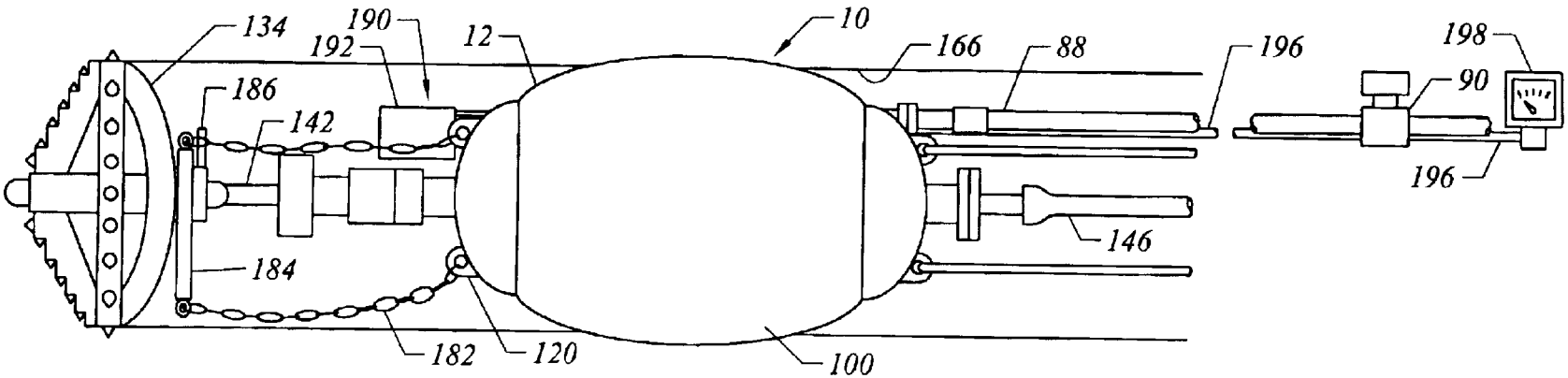
FIG. 6 is a view of the diverter of FIG. 5 with an auxiliary pressure measuring unit and alternate locating device.

As noted, alternate methods of installing and removing the diverter 10 are facilitated by the design of the diverter unit 12. In the schematic illustration of FIG. 6, the eye brackets 120 on the side of the diverter swivel unit 14 are connected to short chains 182 connected to a steel ring collar 184. The collar 184 shown mounted over a vertically projecting nub 186 welded to the end of the reamer 134. In this procedure for positioning the diverter 10, a length of the bore from the exit portal 138 has been enlarged to the location for setting the diverter 10. The pipe tail 146 is advanced through the exit portal 146 to permit the collar 184 to be connected to the reamer 134 by placement over the nub 186. Without rotating the pipe string 142 the pipe string in drawn back through the bore until the diverter is positioned at the desired location in the enlarged bore. After inflating the bladder 100 and anchoring the diverter 10, the pipe string 142 is rotated and drawn, slipping the collar from the reamer 134 when the nub is downwardly directed. With the diverter 10 released, the enlargement of the bore by the reamer 134 continues to the entry portal 130.

Figure 2:
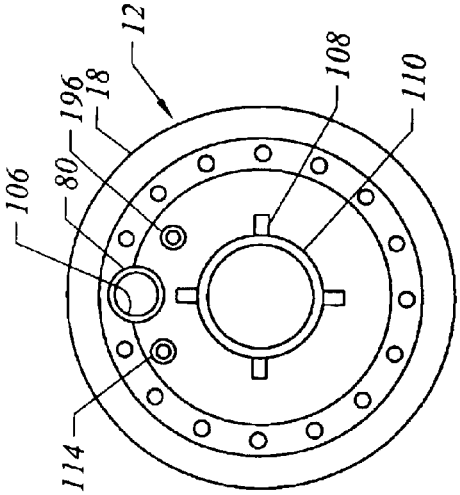
FIG. 2 is a cross-sectional view taken on the lines 2—2 in FIG. 1.

As an auxiliary component to the diverter system. The diverter 10 in the embodiment of FIG. 6 includes a pressure measuring unit 190. The pressure measuring unit includes a compressible, cylindrical bladder 192 projecting from the end cap 16 adjacent the pipe stub 72 of the bypass assembly 70. The compressible bladder 192 is connected to a pressure line 196 through the diverter unit 12 as indicated in FIG. 2 to a pressure gauge 198 at or near the exit pit 140. This gauge 198 accurately indicates the pressure of the drilling mud and provides advance warning of activation of the bypass, allowing corrective action to be taken to avert potential activation.

In addition, drilling mud pressure can be tracked and unexpected drops in pressure can be detected that may indicate a breach in the bore or other abnormality that requires attention.

Since horizontal drilling operations occasionally encounter the unexpected, the diverter system of this invention includes a mud diverter 10 having a rugged construction designed with components that provide options for locating and removing the diverter unit as the situation requires.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A drilling mud diverter for use in horizontal drilling with drill pipe and drilling mud, the mud diverter comprising:

a diverter unit having:

a cylindrical core with opposite ends;

a first end cap connected to one end of the cylindrical core and a second end cap connected to the other end of the cylindrical core, wherein the first end cap and second end cap each have a guide element for guiding a drill pipe through the end caps and cylindrical core;

a pressure relief bypass assembly having a bypass through the end caps and cylindrical core that passes pressurized drilling mud through the diverter unit; and, an annular expandable bladder on the cylindrical core between the end caps.

2. The drilling mud diverter of claim 1 having a pressurized air supply to the expandable bladder for expanding the bladder.

3. The drilling mud diverter of claim 2 wherein the diameter of the end caps is greater than the diameter of the cylindrical core.

4. The drilling mud diverter of claim 3 wherein the expandable bladder when deflated on the cylindrical core has an outer diameter substantially equal to the diameter of the end caps.

5. The drilling mud diverter of claim 1 wherein the bypass assembly has a bypass pipe through the diverter unit forming the bypass passage.

6. The drilling mud diverter of claim 1 wherein the bypass assembly has a pressure relief valve that passes pressurized drilling mud through the diverter unit at a selected pressure.

7. The drilling mud diverter of claim 1 wherein the bypass assembly has a bypass pipe through the diverter unit connected to a conduit having a pressure relief valve for passing pressurized drilling mud through the diverter unit at a specified pressure.

8. The drilling mud diverter of claim 1 further comprising a swivel assembly connected to one of the guide elements.

9. The drilling mud diverter of claim 1 further comprising a swivel unit connected to the diverter unit, the swivel unit having a swivel assembly and a seal assembly.

10. The drilling mud diverter of claim 9 wherein the swivel assembly is connected to one of the guide elements of the diverter unit.

11. In a horizontal drilling operation with drill pipe, the method of diverting drilling muds to one of first and second entry portals of a drilled bore using a mud diverter having an inflatable bladder comprising the steps of:

enlarging at least a part of the drilled bore at the first entry portal forming an enlarged bore to accommodate the mud diverter;

connecting the mud diverter to drill pipe at the first entry portal of the drilled bore;

displacing the drill pipe in the drilled bore with the mud diverter connected to the drill pipe;

transporting the mud diverter through the first entry portal into the enlarged bore;

positioning the diverter at a desired location in the enlarged bore;

expanding the inflatable bladder of the diverter in the enlarged bore to fix the position of the diverter at a desired location in the enlarged bore;

releasing the coupled diverter from the drill pipe;

blocking the drilling mud from passing to the first entry portal through which the diverter was transported; and, continuing the displacement of the drill pipe to continue enlarging the bore.

12. The method of claim 11 wherein the step of enlarging at least a part of the drilled bore to accommodate the mud diverter occurs after the step of connecting the mud diverter to the drill pipe.

13. The method of claim 11 wherein the diverter has a bypass passage through the diverter with a pressure release to block drilling mud from passing through the bypass unless a set pressure has been exceeded.

14. The method of claim 12, including the step of setting the pressure release with a specified pressure before continuing the displacement of the drill pipe to continue enlarging the bore.

15. The method of claim 11 including the step of anchoring the mud diverter to prevent displacement of the diverter before continuing the displacement of the drill pipe to continue enlarging the bore.

16. The method of claim 11 wherein the diverter includes a pressure tracking unit that measures the pressure of drilling mud blocked by the diverter.

17. The method of claim 16 including the step of tracking the pressure of the drilling mud after continuing the displacement of the drill pipe to continue enlarging the bore.

18. The method of claim 11 including the step of withdrawing the diverter after the bore has been enlarged.

19. The method of claim 18 wherein the diverter is connected to the drill pipe after the bore has been enlarged and the diverter is withdrawn by the step of displacing the drill pipe.

20. The method of claim 18 wherein the diverter is connected to cables and the diverter is withdrawn by the cables after the bore has been enlarged.

* * * * *